US007690086B2

(12) United States Patent
Dilo

(10) Patent No.: US 7,690,086 B2
(45) Date of Patent: Apr. 6, 2010

(54) FLEECE-LAYING APPARATUS

(75) Inventor: Johann P. Dilo, Eberbach (DE)

(73) Assignee: Oskar Dilo Maschinenfabrik KG, Eberbach (DE)

( * ) Notice: Subject to any disclaimer, the term of this patent is extended or adjusted under 35 U.S.C. 154(b) by 230 days.

(21) Appl. No.: 12/056,994

(22) Filed: Mar. 27, 2008

(65) Prior Publication Data

US 2008/0235916 A1 Oct. 2, 2008

(30) Foreign Application Priority Data

Mar. 30, 2007 (EP) ..... 07006704

(51) Int. Cl.
*D01G 25/00* (2006.01)

(52) U.S. Cl. ..... 19/163

(58) Field of Classification Search ..... 19/163; 270/30.1, 30.11

See application file for complete search history.

(56) References Cited

U.S. PATENT DOCUMENTS

| | | | | |
|---|---|---|---|---|
| 5,590,442 | A | 1/1997 | Herwig et al. | |
| RE35,982 | E * | 12/1998 | Freund | 191/63 |
| 6,195,844 | B1 * | 3/2001 | Jourde et al. | 19/163 |

FOREIGN PATENT DOCUMENTS

| | | |
|---|---|---|
| DE | 195 43 623 | 5/1997 |
| EP | 0 786 545 | 1/1997 |
| EP | 1 136 600 | 3/2000 |
| WO | WO 97/19209 | 5/1997 |

* cited by examiner

*Primary Examiner*—Shaun R Hurley
(74) *Attorney, Agent, or Firm*—Jansson Shupe & Munger Ltd.

(57) ABSTRACT

A fleece-laying apparatus with an upper carriage (4) and a laying carriage (5) which move above an output conveyor belt (2) transversely to the transport direction of that belt to lay a card web (11) supplied to the fleece layer in partially overlapping layers on an output conveyor belt (2), an endless card web conveyor belt (14) traveling exclusively in the laying carriage (5) wraps around at least one first laying roller (12) in the laying carriage (5). The belt has upper and lower strands (14*o*, 14*u*), which extend between the first laying roller (12) and a deflecting roller (15), which is supported in the laying carriage a certain distance away from the laying roller and around which the belt partially wraps. The lower strand (14*u*) of the web conveyor belt (14) traveling around exclusively in the laying carriage (5) passes only a very short distance away from the output conveyor belt (2), and its upper strand (14*o*), namely, a section of the upper strand adjacent to the laying gap, supports a length of the card web (11) to be laid from underneath. This length of the card web (11) is covered by the opposing section of another traveling card web guide belt (6).

12 Claims, 1 Drawing Sheet

FLEECE-LAYING APPARATUS

CROSS REFERENCE TO RELATED APPLICATION

This application claims priority to European patent application EP 07 006 704.6, filed Mar. 30, 2007.

FIELD OF THE INVENTION

The invention pertains to a fleece-laying apparatus, such apparatus sometimes being referred to herein as a "fleece layer." The invention is a fleece-laying apparatus having an upper carriage and a laying carriage which are guided in a machine stand so as to move above, and transversely with respect to, the direction of movement of an output conveyor belt traveling around in the stand, and further having conveyor belts which enclose sandwich-like the card web to be laid on its way from a web entrance to a laying gap so that the card web supplied to the fleece layer can be deposited in partially overlapping layers on the output conveyor belt.

BACKGROUND

A fleece layer of the previously described type is known from EP 0 865 521 B1, in which a first card web conveyor belt supplying the card web is routed both through the upper carriage and through the laying carriage and then continues through an auxiliary carriage, which can be moved back and forth underneath and transversely to the output conveyor belt. This auxiliary carriage supports a tensioning roll and serves to keep the card web conveyor belt under tension. A second card web conveyor belt is also routed through the upper carriage and the laying carriage and then passes through a second auxiliary carriage, which can be moved back and forth underneath and transversely to the output conveyor belt in the machine stand; this auxiliary carriage supports another tensioning roll and serves to keep the second card web conveyor belt under tension.

In the upper carriage, the first card web-supplying conveyor belt travels over two rollers, which are arranged at different heights and which are offset from each other transversely to their axial direction, so that the web entrance slants downward. This slanted web entrance in the upper carriage is accompanied by the second web card conveyor belt, which proceeds from there to the area between the upper carriage and the laying carriage, where it extends parallel to the first web conveyor belt, together with which it encloses, sandwich-like, the card web to be laid. The two web conveyor belts cannot be routed so that they are parallel to each other at the lower deflecting roll in the upper carriage because different wrap-around radii are present, which would lead to frictional effects potentially damaging to the guided card web. The second web conveyor belt is therefore routed through the upper carriage over a total of four separate deflecting rollers in the area of the previously mentioned lower deflecting roller before it approaches the first web conveyor belt again. Corresponding measures are also taken for the first web conveyor belt in the laying carriage, because this belt, for the same reasons as those explained above, cannot be guided together with the second web conveyor belt into the laying gap in the laying carriage.

The strands of the two web conveyor belts leaving the laying carriage at the laying gap extend just above the output conveyor belt and take over there the function of covering the laid fleece to protect it from aerodynamic disturbances caused by the movement of the laying carriage.

What is obtained overall, therefore, is a very complicated routing of the two web conveyor belts both in the upper carriage and in the laying carriage and also in the two tension carriages. There are thus a large number of belt deflection points, and the belts are of considerable length.

A much simpler and shorter routing of the belts participating in the transport of the card web is present in the carriage cross-lappers described in Vliesstoffe (Nonwovens) by W. Albrecht, H. Fuchs, and W. Kittelmann (published by Wiley-VCH, Weinheim, 2000, p. 161). The advantage of this type of fleece layer is to be found in the extremely simple way in which the belts participating in the transport of the card web are routed, all of the belts being relatively short and traveling over only a few deflection points. Nevertheless, the route taken by the card web through the layer is open, and so is the deposition of the web on the output conveyor belt. As a result, the card web is exposed to strong aerodynamic influences, which are caused by the movement of the carriages and which can have the effect of blowing the fibers away and of causing the web to be deposited nonuniformly, especially at the edges of the laid nonwoven. The working speed of a fleece layer of this type is therefore very limited. Another disadvantage of the carriage cross-lappers mentioned above is that they cannot exert any pressure on the top side of the laid fleece without causing significant distortions, pile-ups, and folds in the fleece. This type of layer has therefore been displaced by double-belt layers, for which the fleece layer according to the previously mentioned EP 0 865 521 B1 can serve as one of many examples. In this type of layer, the card web, as it travels though the machine, is guided horizontally between two belts, one on each side, which explains why this is also called a "sandwich layer". In the layers of the type just described, these belts also serve as a covering for the nonwoven which has been deposited on the output conveyor belt and thus protect it from the previously mentioned air turbulence, although at the cost of the previously described complicated belt routing.

SUMMARY OF THE INVENTION

It is an object of the present invention to provide a fleece layer of the type described above which has a simplified routing of the belts participating in the transport and guidance of the card web but which also allows a high working speed.

The invention creates a novel combination of a carriage cross-lapper and one of the known sandwich layers. From the sandwich layers, it adopts the movable web entrance, which is shifted to the upper carriage. As the laying carriage, it uses one of those known from the carriage cross-lappers, in which an endless conveyor belt travels around in the carriage. The upper carriage, the laying carriage, and output conveyor belt are moved so close together, however, that the card web, on its way from the web entrance to the laying gap, is enclosed, sandwich-like, between the conveyor belts, and the laid fleece on the output conveyor belt is contacted and therefore covered by the lower strands of the conveyor belts.

A special feature of the invention is therefore that an endless card web conveyor belt, which travels around exclusively in the laying carriage and which therefore, together with this carriage, moves back and forth transversely to the output conveyor belt, is used to guide the card web in the laying carriage. This endless belt traveling only in the laying carriage participates in the transport of the card web in the direction toward the laying gap and at the same time covers the fleece which has been produced from the laid card webs and which is lying on the output conveyor belt. Because of the exposed routing of the conveyor belts in the carriage-type fleece layers, the conveyor belts had to have a certain surface structure to guarantee the transport function; the conveyor belt which has been adopted from the carriage-type layers and which travels in the laying carriage can nevertheless have the smooth surface required to cover the fleece, because the transport function for the card web is fulfilled by the sandwich-like enclosure of the web between the lower strand of the card web-supplying conveyor belt, which is guided through the web entrance and which is called the "web entrance conveyor belt" below, and the upper strand of the conveyor belt traveling in the laying carriage, called the "laying carriage conveyor belt" below.

The laying carriage conveyor belt traveling around in the laying carriage wraps around not only one of the rollers forming the boundary of the laying gap, called the "laying rollers" below, but also around a deflecting roller supported in the laying carriage a certain distance away from the laying rollers. When supported so that its height is adjustable, this deflecting roller offers the possibility of taking into account in a special manner the direction in which the laying carriage is moving. That is, if the diameter of this deflecting roller is made smaller than that of the associated laying roller, then, by adjusting the height of the deflecting roller and by taking other measures to be explained in detail later, it is possible to give optimal cover conditions for covering the laid fleece in both directions of movement of the laying carriage by means of the laying carriage conveyor belt mentioned above.

The inventive fleece layer is preferably equipped with a slanted web entrance, comparable to the prior art described in the previously mentioned EP 0 865 521 B1, which is situated on the movable upper carriage. The card web being supplied via the upper carriage arrives on the upper strand of the laying carriage conveyor belt, from which it is transported into the laying gap in the laying carriage. On its way there, the web is accompanied and covered by the card web-supplying web entrance conveyor belt, which runs along the laying carriage, over a deflecting roller, and from there via the second laying roller through the laying gap, from which the belt then extends transversely across the output conveyor belt, where it serves a covering function. The previously mentioned deflecting roller is the only roller which serves to prevent the previously explained frictional effects which result when two web-enclosing belts travel around one and the same deflecting roller and therefore describe paths of different radii. After emerging from the laying gap, the web entrance conveyor belt travels over the laid fleece and onward via a tensioning roller supported in a movable belt-tensioning carriage back to the slanted web entrance.

In one aspect of the invention, the number of deflection points for the card web and for the belts which guide it is extremely small. Nevertheless, it occupies somewhat more space on one side of the output conveyor belt to accommodate the laying carriage, which, in one of its directions of movement, travels laterally considerably beyond the output conveyor belt. The inventive fleece layer is therefore of interest especially for narrow laying widths.

According to another aspect of the invention, the fleece layer also offers the advantage that the card web to be laid can be guided in the manner of a genuine "sandwich" for all possible card web thicknesses, because the design of the fleece layer makes it possible to adjust the height of the web-guiding belts with respect to each other very easily in the area between the upper carriage and the laying carriage. The distance between the belts can be made zero in this area. For this purpose, it is sufficient for the path along which the laying carriage travels to be height-adjustable. The desired contact between the lower strands of the web-laying belts and the laid fleece can be produced by adjusting the height of the output conveyor belt in its lower stand and can extend all the way to light pressure.

The invention is explained in greater detail below with reference to an exemplary embodiment, which is illustrated in the drawing.

DESCRIPTION OF THE DRAWING

The single drawing shows a schematic diagram of an embodiment corresponding to the invention.

The drawing shows only the most essential elements of the invention, namely, those which are necessary for explanatory purposes. Unnecessary items have been omitted so as not to overload the drawing with details which are not necessary to explain the invention.

DETAILED DESCRIPTION OF A PREFERRED EMBODIMENT

Figure 1:
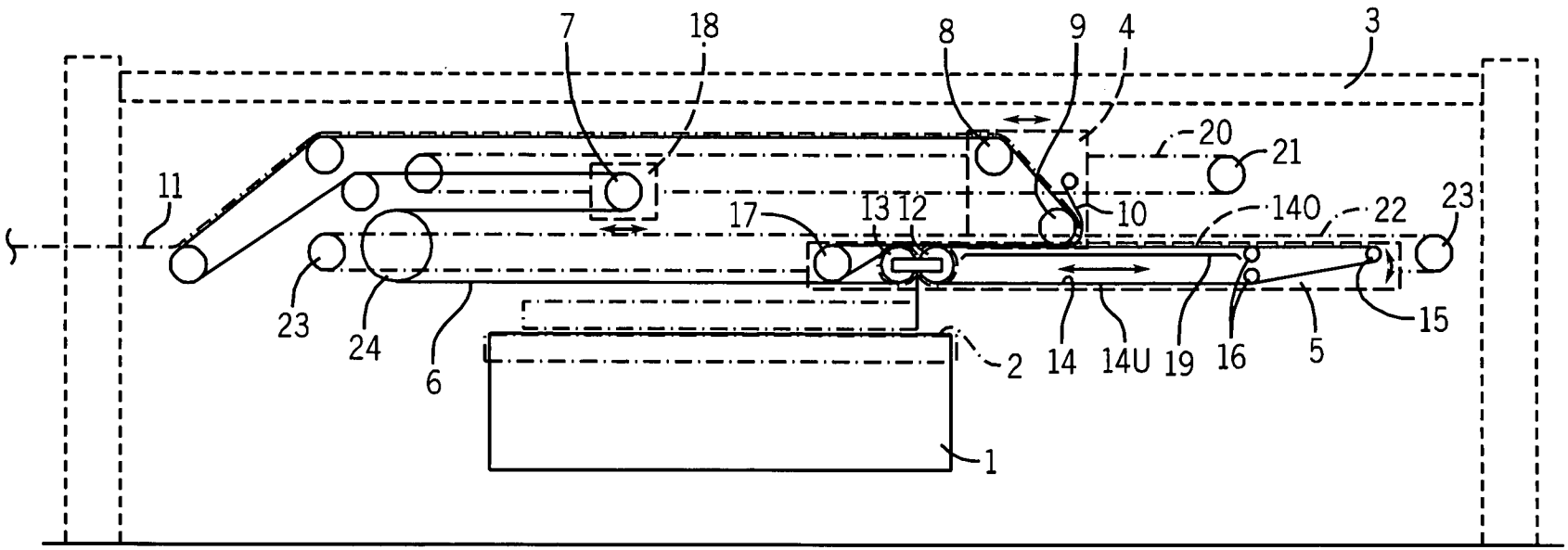

The drawing shows a preferred embodiment of the invention. A schematic diagram of a fleece layer is presented, consisting of: an output conveyor belt 2 supported in a lower stand 1, this belt being designed as, for example, a slatted belt, one of its deflecting rollers being indicated schematically; an upper carriage 4, which can travel back and forth in a machine stand 3 (illustrated schematically) transversely to the transport direction of the output conveyor belt 2; and a laying carriage 5, which can travel back and forth underneath the upper carriage, also transversely to the output conveyor belt 2.

A web-carrying conveyor belt, called the web entrance conveyor belt 6 in the following to distinguish it from the other belts, travels through the upper carriage 4 and the laying carriage 5, passing over several deflecting rollers supported in the machine stand 3, some of which are stationary deflecting rollers, and one of which is a belt-tensioning roller 7, which is mounted in a sliding or belt-tensioning carriage 18, which moves horizontally back and forth in the machine stand 3. At least one of the stationary rollers, e.g., roller 24, is motor-driven, which is symbolized in the drawing by a circle with two black sectors.

The upper carriage 4 has two deflecting rollers 8 and 9, which are arranged at different heights and with a certain lateral offset from each other, so that a downward-slanting web entrance is obtained in the known manner. At the lower deflecting roller 9, the web entrance conveyor belt 6 is deflected by more than 90°, and opposite it at this point in the upper carriage 4 is preferably a stationary but resilient web guide device 10, which serves to improve the guidance of the card web 11 being brought up by the web entrance conveyor belt 6 and which is also preferably air-permeable, so that entrained air can escape unhindered from the card web 11.

Two deflecting rollers 12 and 13 are supported close together and parallel to each other in the laying carriage 5. To distinguish them from other deflecting rollers, these are called the first and second laying rollers, as previously mentioned. An endless web guide belt 14, which travels around only inside the laying carriage 5 and which is called the laying carriage conveyor belt in the following, wraps around the first laying roller 12. This belt 14 has un upper strand 14*o* and a lower strand 14*u*. It travels over a deflecting roller 15 arranged a certain distance away from the first laying roller 12 and wraps around it. A belt spreader 16, which, in the example shown here, is formed by two freewheeling belt guide rollers 16 of relatively small diameter, that is, of a diameter smaller than that of the first laying roller 12, is located in the laying carriage between the first laying roller 12 and the deflecting roller 15. This belt spreader 16 serves to keep the upper and lower strands 14*o*, 14*u* of the laying carriage conveyor belt 14 parallel to each other, namely, the sections of the strands between the belt spreader 16 and the first laying roller 12. The deflecting roller 15 also has a comparatively small diameter and is supported in the laying carriage 5 so that its height is adjustable, as illustrated by the double arrow in the drawing.

The laying carriage conveyor belt 14 wrapping around the first laying roller 12 forms a certain belt section between the lower belt guide roller of the belt spreader 16 and the deflecting roller 15 at the farthest point away from the first laying roller 12; when the laying carriage 5 is moving to the right, this section slants upward, because, in this situation, the deflecting roller 15 has been brought into the raised position shown in the drawing. In the opposite direction of movement of the laying carriage 5, the deflecting roller 15 is lowered (not shown) to the level of the lower belt guide roller of the belt spreader 16. The upper strand 14*o* of the laying carriage conveyor belt 14 is preferably supported from below by smooth plates 19, for example, located in the horizontal section between the first laying roller 12 and the belt spreader 16.

So that the height of the deflecting roller 15 can be changed, adjusting devices (not shown) can be present in the machine stand 3, which selectively actuate drivers (not shown) attached to the deflecting roller 15 or to a movable frame which holds the roller, so that the actual height of the deflecting roller 15 is the result of the current position and direction of movement of the laying carriage. The adjusting devices can be of pneumatic design, for example. The deflecting roller 15 could also be supported on a pivot arm, which is supported in the space enclosed by the belt 14, and which is under the influence of tension springs anchored in the laying carriage 5 or possibly only under the influence of the tensile forces proceeding from the belt 14 itself. The forces of the springs or of the belt secure the deflecting roller 15 in its upper and lower end positions, which thus become stable positions, whereas the intermediate positions are unstable, which means that the adjusting devices merely initiate the change in height. Once initiated, the rest of the movement occurs automatically.

A deflecting roller 17 is supported in the laying carriage 5 parallel to the two laying rollers 12 and 13. The web entrance conveyor belt 6, coming from the lower deflecting roller 9 in the upper carriage 4, travels around this deflecting roller 17 and proceeds back toward the second laying roller 13 and wraps around it. Proceeding from the second laying roller 13, the web entrance conveyor belt 6 travels to the driven deflecting roller 24, remaining at the same height as the lower strand 14*u* of the laying carriage conveyor belt 14. It is thus able to cover the fleece lying on the output conveyor belt 2. After passing around the deflecting roller 24, it travels over the previously mentioned belt-tensioning roller 7 and over various other rollers on its way back to the slanted web entrance.

As can be seen from the drawing, the card web 11 being supplied to the fleece layer takes the following route to the output conveyor belt:

The card web 11 carried along by the web entrance conveyor belt 6 travels along the upper carriage at a downward slant in the area between the deflecting rollers 8 and 9 and then arrives on the upper strand 14*o* of the laying carriage conveyor belt 14. From there, its top side is covered by the lower strand of the web entrance conveyor belt 6, which wraps partially around the lower deflecting roller 9 and then travels toward the laying carriage 5. The card web 11 then arrives at the laying gap between the laying rollers 12 and 13, around which the two belts 14 and 6 partially wrap. From the laying gap, the card web 11 arrives on the output conveyor belt 2. In the drawing, several layers of card web are shown on top of each other, forming a kind of package.

It should be pointed out here that the distance relationships between the lower strands of the belts 6 and 14 and the output conveyor belt 2 are not shown to scale, because the previously mentioned lower strands are intended to serve the purpose of covering the laid fleece to protect it from the damaging aerodynamic influences caused by the movement of the laying carriage 5, and they therefore in practice travel very close to the laid fleece or actually touch it, possibly even with a certain amount of pressure, during the operation of the machine.

To drive the upper carriage 4 back and forth, a first toothed belt 20 is provided, which passes over a drive pinion 21 supported in the machine stand 3. The first toothed belt 20 is connected to the upper carriage 4 and to the belt-tensioning carriage 18 and therefore necessarily moves the two carriages synchronously and in opposite directions. To drive the laying carriage 5, a second toothed belt 22 is provided, which is connected to the laying carriage 5 and passes over two pinions 23 supported in the machine stand, one of which is driven. The laying rollers 12 and 13 are in toothed engagement with each other, so that they necessarily rotate in opposite directions. They are driven by the web entrance conveyor belt 6, i.e., by the contact of the web entrance conveyor belt 6 with the second laying roller 13. For this purpose the belt can have a suitable surface structuring on its rear surface, i.e., the surface which does not come in contact with the card web 11. The laying carriage conveyor belt 14 can be driven in the same way by contact with the first laying roller 12. This belt, too, can have a suitable surface structuring on its rear surface. The web entrance conveyor belt 6 is driven by the deflecting roller 24.

During the operation of this fleece layer, the laying carriage 5 moves back and forth transversely in the direction of the double arrow in the machine frame 3 above the lower stand 1, that is, above the output conveyor belt 2 supported there, between the edges of the output conveyor belt 2. The upper carriage 4 moves in the known manner at half the speed of the laying carriage, whereas the belt-tensioning carriage 18 with the belt-tensioning roller 7 supported in it is moved in the opposite direction via the toothed belt 20. The section of card web 11 lying on the upper strand 14*o* of the laying carriage conveyor belt 14 increases in length as the laying carriage 5 moves to the left from the position shown in the drawing. Conversely, the length of this section decreases when the laying carriage 5 moves in the opposite direction.

While the laying carriage 5 is moving toward the left in the situation shown in the drawing, the lower strand of the web entrance conveyor belt 6 passes very closely over the laid fleece at twice the speed of the laying carriage 5. So that this does not cause any interfering effects on the laid fleece, this web entrance conveyor belt 6 should be as smooth as possible on the side facing the fleece. The lower strand 14*u* of the laying carriage conveyor belt 14, which is being pulled from the laying gap between the two laying rollers 12 and 13 downstream, as it were, from the laying gap, lies on the laid fleece without relative velocity with respect to it, because the circumferential velocity of the first laying roller 12 is exactly the same as the travel velocity of the laying carriage 5, which in turn is the same as the feed velocity of the card web 11 on the web entrance conveyor belt 6. In this direction of movement of the laying carriage 5, it is in fact possible for the fleece to be completely covered downstream of the laying gap. By lowering the deflecting roller 15 of the laying carriage conveyor belt 14 to such an extent that the section of the lower strand 14*u* of the laying carriage conveyor belt 14 located all the way to the right in the drawing also lies on the laid fleece, the entire width of the laid fleece can be covered.

When the laying carriage 5 is traveling in the opposite direction, the lower strand 14*u* of the laying carriage conveyor belt 14 passes over the laid fleece at twice the speed of the laying carriage 5. Therefore, when the laying carriage 5 is moving in this direction, it is advantageous for a gradually tapering entry gap to be formed between the forward end of the laying carriage conveyor belt 14 covering the fleece and the fleece, which can be achieved by raising the deflecting roller 15 into the position shown in the drawing.

It can be seen in the drawing that the card web 11 has only two critical deflection points inside the fleece layer, namely, at the lower deflecting roller 9 of the upper carriage 4, where it is deflected by approximately 135°, and at the entrance to the laying gap, where it is deflected by 90°. The routing of the card web-guiding belts is very simple also. The web entrance conveyor belt 6 supplying the card web 11 passes merely through the upper carriage 4 and the laying carriage 5 and then through the belt-tensioning carriage 18 supporting the belt-tensioning roller 7 and over several stationary deflecting rollers, as usual. A second, comparable web conveyor belt, which is routed through both carriages, however, is absent. Instead, the invention makes do with a kind of auxiliary belt, which, in the form of the laying carriage conveyor belt 14, travels exclusively in the laying carriage 5 and is transported back and forth along with it. There is no need for separate cover belts, because their function is taken over by the lower strands of the two previously mentioned belts 6 and 14.

When the height of the laying carriage 5 versus that of the upper carriage 4 is changed to accommodate card webs of different thicknesses, the width of the gap which is present between the web entrance conveyor belt 6 and the opposing upper strand 14*o* of the laying carriage conveyor belt 14 also changes. To keep the two belts parallel to each other, it is advantageous for the deflecting roller 17 in the laying carriage 5 to be height-adjustable; that is, it would be raised correspondingly, for example, when the laying carriage 5 is lowered. To take into account the height adjustment of the laying carriage 5, the height of the output conveyor belt 2 is also preferably adjustable. Instead of changing the height of the laying carriage 5, it would also be possible to consider changing the height of the upper carriage 4.

The invention claimed is:

1. A fleece-laying apparatus comprising:

an upper carriage and a laying carriage which are guided in a machine stand so as to move above, and transversely to, the direction of movement of an output conveyor belt traveling around in the stand, to lay a card web supplied to the fleece layer in partially overlapping layers on the output conveyor belt;

a web entrance conveyor belt which supplies the card web and which is deflected in the upper carriage and guided through the laying carriage; and first and second laying rollers which are arranged parallel to each other in the laying carriage, around each of which a card web-carrying belt partially wraps and which, by means of the belt's partially wrapping around them, form a laying gap through which the card web is guided onto the output conveyor belt, wherein the belt wrapping around the first laying roller is an endless laying carriage conveyor belt which travels around exclusively in the laying carriage and which has upper and lower strands that extend between the first laying roller and a deflecting roller around which they partially wrap, the deflecting roller being arranged in the laying carriage a certain distance away from the first laying roller, wherein the lower strand of the laying carriage conveyor belt extends above the output conveyor belt and transversely to it, and wherein a certain length of the card web to be laid is supported from underneath by the upper strand of the laying carriage conveyor belt in the section adjacent to the laying gap, this length of the card web being covered by a portion of the web entrance conveyor belt extending between the upper carriage and the laying carriage.

2. The fleece-laying apparatus according to claim 1 wherein the web entrance conveyor belt wraps partially around the second laying roller and from there extends over the output conveyor belt at the same level as the lower strand of the laying carriage conveyor belt.

3. The fleece-laying apparatus according to claim 1 wherein the upper carriage is guided on a guide device, which is mounted in height-adjustable fashion in the machine stand.

4. The fleece-laying apparatus according to claim 3 wherein the upper strand of the laying carriage conveyor belt is supported from underneath.

5. The fleece-laying apparatus according to claim 1 wherein the height of the output conveyor belt is adjustable.

6. The fleece-laying apparatus according to claim 1 wherein, in the laying carriage, a certain distance away from the first laying roller, a belt spreader is provided which is adapted to keep the upper and lower strands of the laying carriage conveyor belt parallel to each other, and wherein, on the side of the belt spreader facing away from the first laying roller and a certain distance away from the belt spreader, the associated deflecting roller for the laying carriage conveyor belt is supported, this roller having a diameter which is smaller than that of the first laying roller and being supported in the laying carriage in height-adjustable fashion.

7. The fleece-laying apparatus according to claim 6 wherein the belt spreader is formed by a roller with a diameter which is the same as that of the first laying roller.

8. The fleece-laying apparatus according to claim 6 wherein the belt spreader is formed by a guide plate device.

9. The fleece-laying apparatus according to claim 6 wherein the belt spreader is formed by two freewheeling rollers with diameters smaller than that of the first laying roller.

10. The fleece-laying apparatus according to claim 1 wherein the upper strand of the laying carriage conveyor belt is supported from underneath at least in a partial area adjacent to the first laying roller.

11. The fleece-laying apparatus according to claim 1 wherein the laying carriage is guided on a guide device, the height of which in the machine stand is adjustable with respect to the height of the upper carriage.

12. The fleece-laying apparatus according to claim 6 wherein devices are provided in the machine stand to act on the height-adjustable deflecting roller in such a way as to adjust its height.

* * * * *